United States Patent [19]

Kummetz

[11] 4,166,425

[45] Sep. 4, 1979

[54] ELASTIC CONNECTION ASSEMBLY FOR THE MAST OF A SAILBOAT

[76] Inventor: Hans E. Kummetz, Otto-Raggenbass Strasse 4, D-775 Konstanz/Bodensee, Fed. Rep. of Germany

[21] Appl. No.: 822,056

[22] Filed: Aug. 5, 1977

[30] Foreign Application Priority Data

Aug. 13, 1976 [DE] Fed. Rep. of Germany ..... 2636457
Oct. 27, 1976 [DE] Fed. Rep. of Germany ..... 2648784

[51] Int. Cl.[2] ..... B63B 15/02

[52] U.S. Cl. ..... 114/39; 114/90; 9/310 E

[58] Field of Search ..... 9/310 E; 114/39, 90, 114/91, 102; 403/220, 221, 224–226, 228, 229

[56] References Cited

U.S. PATENT DOCUMENTS

| | | | |
|---|---|---|---|
| 2,080,627 | 5/1937 | Morgan | 403/220 |
| 2,571,281 | 10/1951 | Neher | 403/220 |
| 3,437,059 | 4/1969 | Stonier et al. | 403/229 |
| 3,487,800 | 1/1970 | Schweitzer et al. | 114/39 |
| 3,659,300 | 5/1972 | Johnson | 9/310 E |
| 3,802,010 | 4/1974 | Smith | 9/310 E |
| 3,865,061 | 2/1975 | Newman | 114/39 |
| 4,037,553 | 7/1977 | Marker | 9/310 E |

FOREIGN PATENT DOCUMENTS

| | | | |
|---|---|---|---|
| 2540759 | 3/1977 | Fed. Rep. of Germany | 114/39 |

*Primary Examiner*—Trygve M. Blix
*Assistant Examiner*—Jesus D. Sotelo
*Attorney, Agent, or Firm*—Hane, Roberts, Spiecens & Cohen

[57] ABSTRACT

A sailboard for wind surfing comprising a board to which a mast is connected by a heel joint. A sail is stretched on the mast. The heel joint comprises two opposed bushings, one coupled to the mast and the other to the board and a block of material of high elasticity is engaged in the bushings and coupled thereto to permit elastic pivotal movement of the mast by rocking of the bushings on one another. The block of material is resistant to water and heat. The lower bushing is coupled to an insertion pin which can be sealably and rotatably inserted in a recess in the board.

26 Claims, 15 Drawing Figures

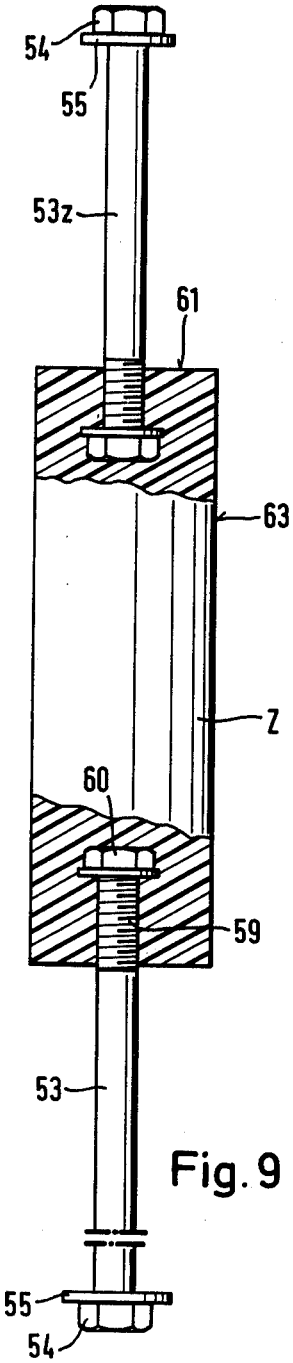
Fig. 9
Fig. 8
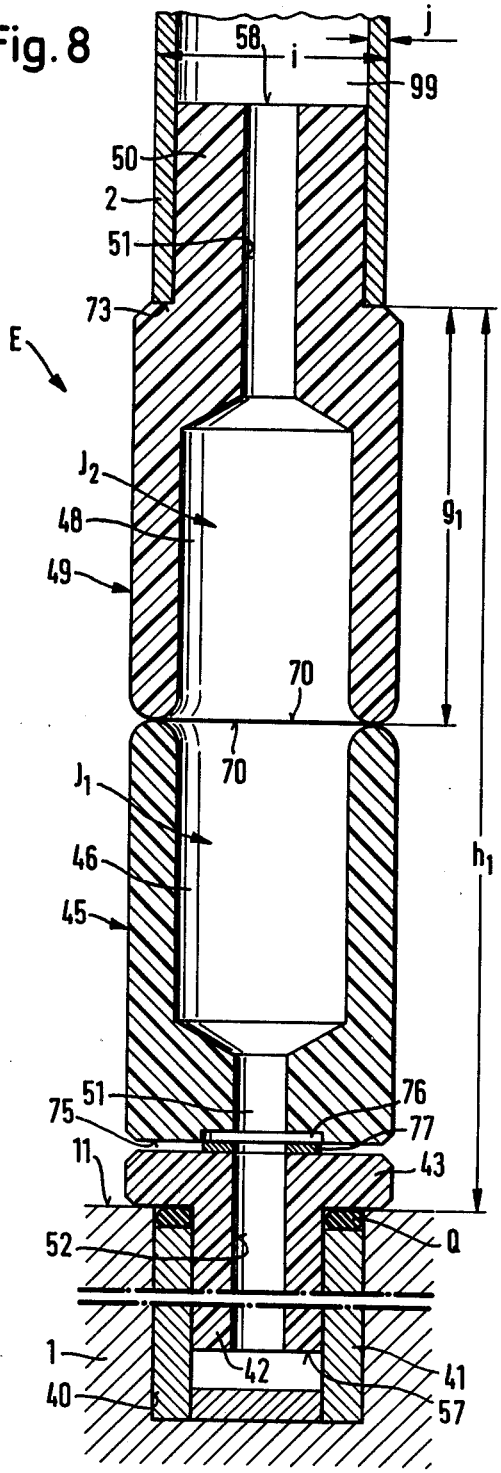

Fig. 12
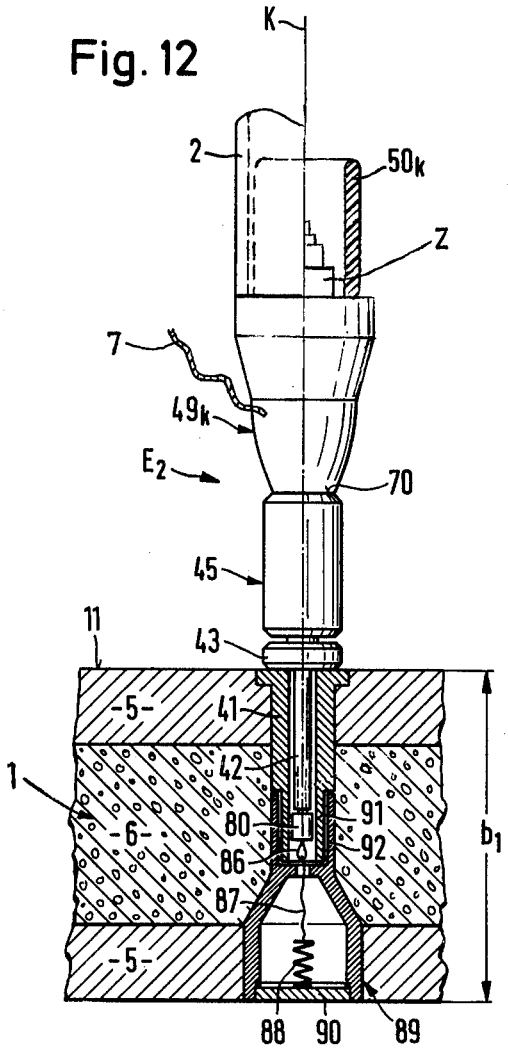
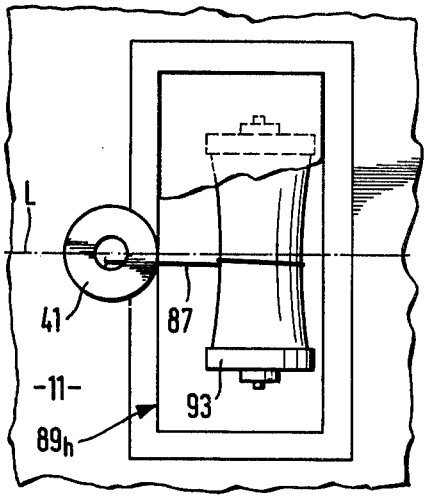
Fig. 14
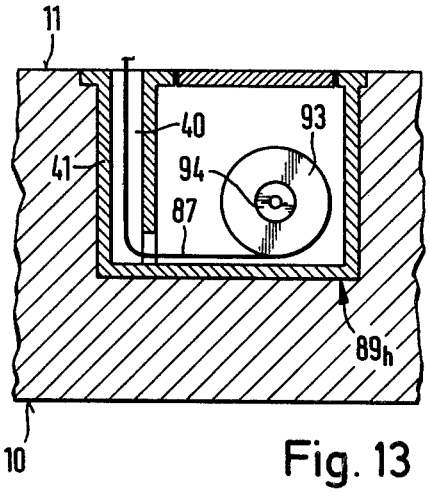
Fig. 13
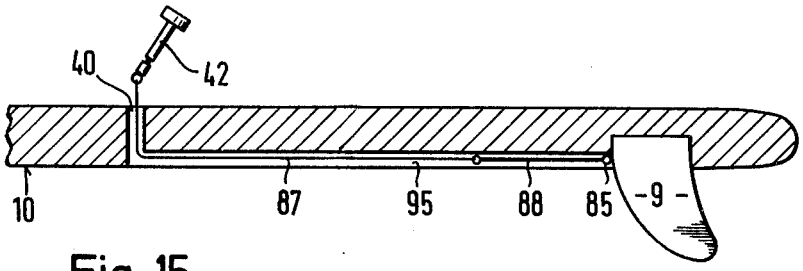
Fig. 15

ELASTIC CONNECTION ASSEMBLY FOR THE MAST OF A SAILBOAT

FIELD OF INVENTION

The present invention relates to a sailboard for wind surfing having a sail attached to a mast and a mast heel joint which holds the mast detachably as well as freely turnable and swingable on the sailboard.

PRIOR ART

From U.S. patent application Ser. No. 716,547 there is already known a sailboard of this type whose mast heel is developed as a metal joint, the mast being capable of being swung around two joints which are at right angles to each other. The mast heel joint is not suitable for the requirements of wind surfing and in particular is not capable of assuring a circular movement of the mast. In addition to this it lacks resistance to breaking and resistance to the weathering influences of the water.

These defects are not eliminated either by the mast heel joint of U.S. Pat. No. 2,353,007 which is developed as a ball joint and if only for this reason does not enter into question for a wind surfboard.

SUMMARY OF THE INVENTION

An object of the invention is to provide a sailboard of the aforementioned type whose mast is connected with the sailboard by a break-proof wear-resistant mast heel joint of simple construction which is movable in all directions. In addition to this, the foot of the sailor is to be protected against injuries from the movement of the mast and the mast is to be held reliably on the sailboard even when the sailor loosens his grip around the mast or a forked boom extending from it.

The object is achieved by a sailboard to which there can be fastened a bushing-like joint part which is connected with a bushing-like mating part arranged on the mast by at least one block or pin of a material of high elasticity which extends into the inside of the bushing and is resistant to water and/or heat. In this connection it has proven particularly favorable to make the block or pin approximately cylindrical and to subject it approximately to the same force or stress conditions in all directions radially with respect to its central axis, thus assuring uniform sailing with any inclination of the mast.

This block or pin in accordance with the invention—of a diameter customarily of for instance 3 cm (and therefore somewhat more than one inch)—is preferably made of an elastomeric material, for instance of so-called EPDM rubber.

Due to the bushing-like development of the outer part of the mast mast heel joint, this block or pin is protected in the normal position of the mast; upon inclination of the mast, a point of the upper part of the joint rolls on the edge of the lower bushing of the joint part, the edges of the bushings being the geometrical locus of the point of contact produced upon the passing of the mast into an inclined position and the deforming of the block. This assures a favorable dissipation of the weight of the mast and in addition—due to the height of the lower joint part socket—freedom for the feet of the sailor.

The fastening of the block or pin in each of the joint bushings is effected either by adhesives or preferably by screw bolts fastened axially in the block, the free ends of which bolts are anchored in the bushings. These screw bolts together with the block or pin furthermore form the holding member for the individual parts of the mast heel joint all of which are held together by the block-bolt unit. The customarily hollow mast of the sailboard is seated on an insertion pin of the upper joint bushing, while the lower joint bushing is connected with an insertion pin which is turnable with respect to it and seated in a cutout in the sailboard.

Within the scope of the invention, furthermore, the insertion pin which is arranged turnably on the lower joint bushing and held by the screw bolt of the block, has at its free end a block, also cylindrical, of elastomeric material, which is traversed by the screw bolt and upon pull on the joint block in the direction of the mast, is deformed to such an extent that it rests in the cutout of the sailboard as a sort of slip brake of the wall of the cutout; the frictional force between the wall of the cutout and this so-called slip brake increases in accordance with the increase of the pull on the mast heel joint!

The invention also contemplates the use of a so-called catch line by means of which the mast or the mast heel joint is still fastened to the sailboard even if the insertion pin has been taken out of the cutout in the sailboard.

It has been found particularly advantageous to conduct this catch line directly at the mast heel into the sailboard in order not to endanger the feet of the sailor by means of a loop in said catch line.

The catch line is preferably fastened—in detachable manner—to the insertion pin of the heel joint while its other end is arranged on the sailboard itself or on a winding device provided in the sailboard. In order to obtain the movability of the mast—required within limits—the catch line furthermore is to have an elastic intermediate member or be arranged on such a member.

BRIEF DESCRIPTION OF THE DRAWING

Further advantages, features, and details of the invention will become evident from the following description of a preferred embodiment and from reference to the drawings in which:

FIG. 8 shows another embodiment of the mast heel joint in sectional view in elevation;

FIG. 9 is a partial section through a joint part in elevation;

FIG. 12 shows a portion of a sailboard corresponding approximately to the showing of FIG. 2;

FIG. 13 shows a partial section corresponding to FIG. 12 through another embodiment;

FIG. 14 is a top view of FIG. 13 (not in section); and

FIG. 15 is a partial section through a sailboard along the line L in FIG. 1.

DETAILED DESCRIPTION

Figure 1:
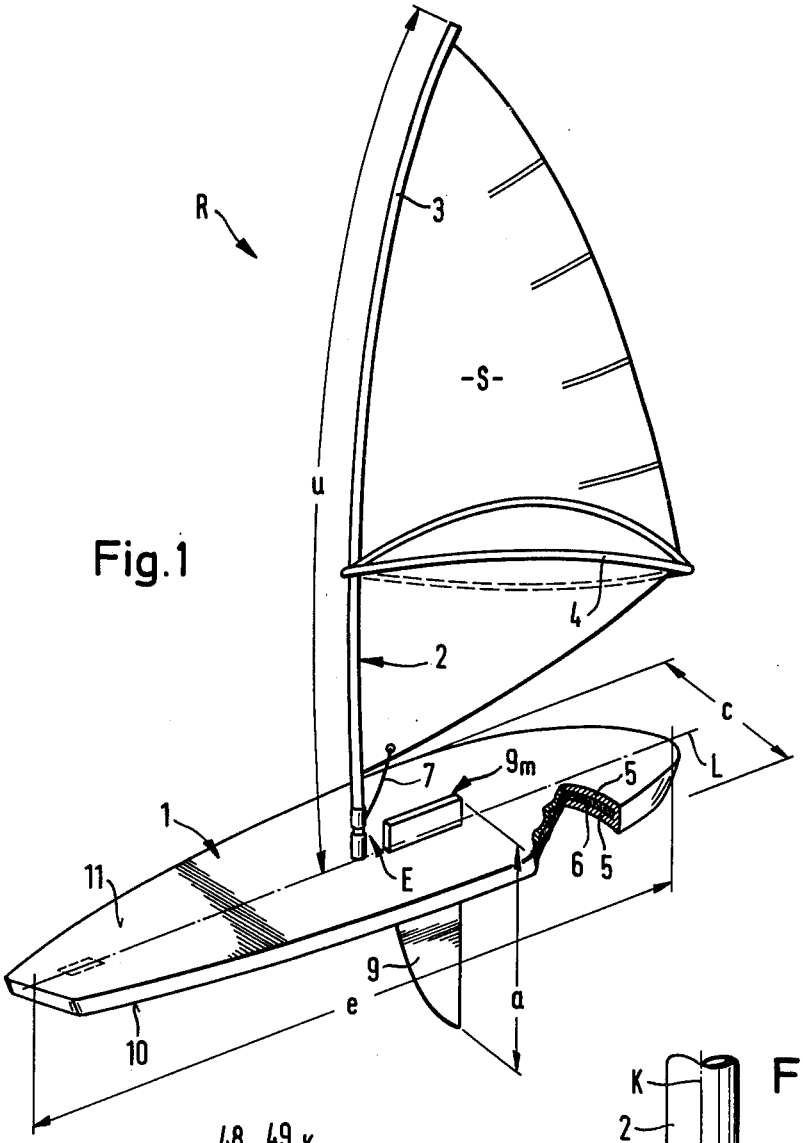
FIG. 1 is an oblique view of a sailboard with mast, shown partly cut-away.

A sailing device R has, on a flat sailboard or water board 1, a mast 2 of the length u of about 450 cm, over which there is pulled the luff 3 developed as hollow seam of a triangular sail and which is stretched by a forked boom 4 on the one hand and a mast heel rope 7 on the other hand.

The sailboard 1 which has a width c of about 70 cm and a length e of almost 400 cm consists of a double-shell aluminum body with a foam filling 6 which has solidified with only few pores, and which can be seen between the aluminum plates 5. Near the mast 2 there extends, along the longitudinal axis L of the sailboard 1, a centerboard box 9*m* for a centerboard 9, displaceable therein, of a height a of for instance 60 cm. Instead of being fastened in the centerboard box 9*m*, the centerboard 9 can also be fixed in a groove, not shown, on the bottom 10 of the board.

Figure 2:
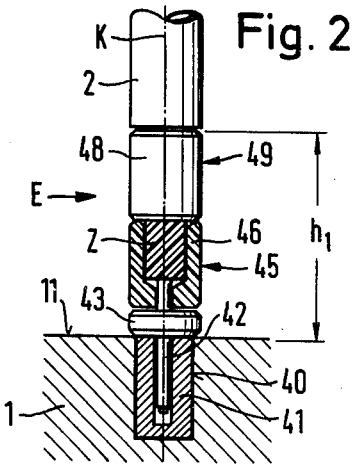
FIG. 2 shows the mast heel joint in a partial section along the line L of FIG. 1.

As the mast heel, there is provided a joint E having, for instance, a free length h (FIG. 4) of 85 mm or $h_1$ of 150 mm (FIGS. 2, 8) which forms the rig of the sailing device R together with the mast 2, the sail S and the forked boom 4.

In a blind hole 40 which extends from the upper standing surface 11 of the sailboard 1 there is fastened a sleeve 41 in which there is firmly seated an axial plug-in pin 42 of the joint part 45 which is close to a board; said joint part rests via the bearing collar 43 of the plug-in pin 42—with the interposition of a sealing ring Q—on the standing surface 11 of the board 1 and terminates towards the mast as a bushing 46 which is open on the top. The inside space $J_1$ of said bushing receives a cylindrical block Z of an elastomer of high extensibility—for instance of so-called EPDM rubber—which at the other end is arranged in the interior $J_2$ of a mating bushing 48 of the second joint part 49 and is surrounded by the two joint parts 45, 49.

Figure 4:
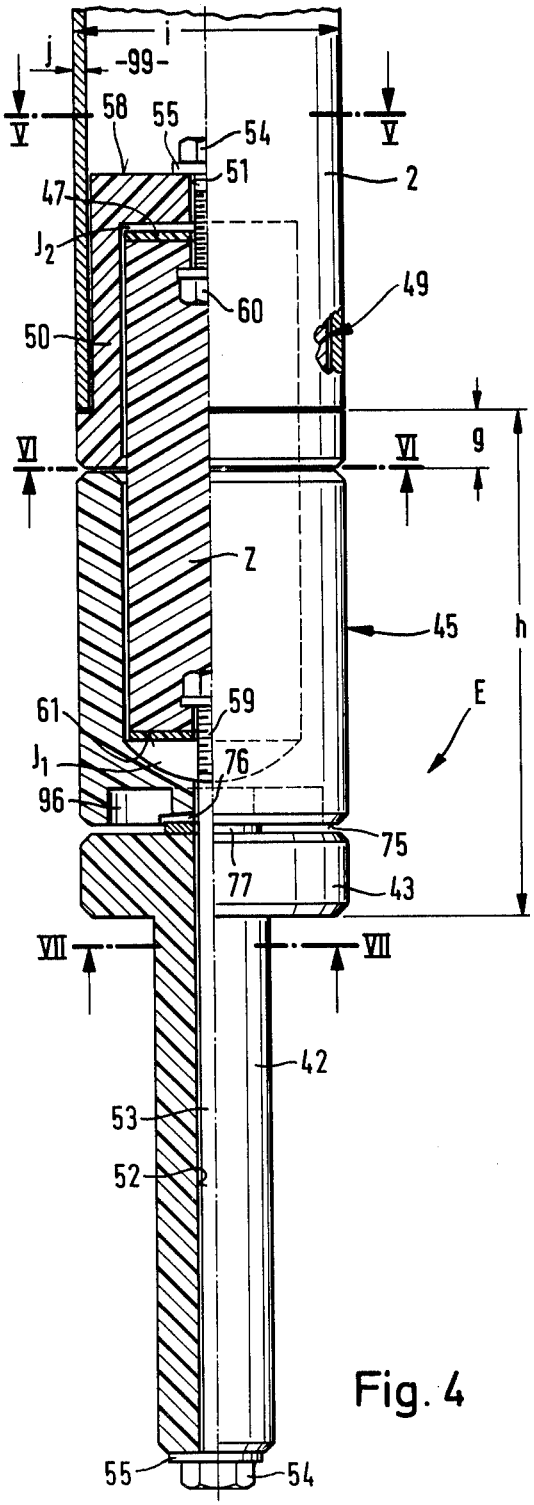
FIG. 4 shows an embodiment of the mast heel joint in approximately true size in elevation partially in section.
Figure 5:
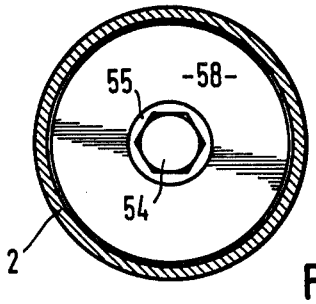
FIG. 5 is a cross section taken along line V—V in FIG. 4.
Figure 6:
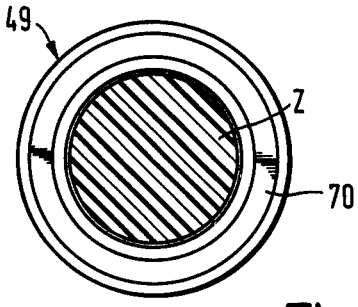
FIG. 6 is a cross section taken along line VI—VI in FIG. 4.
Figure 7:
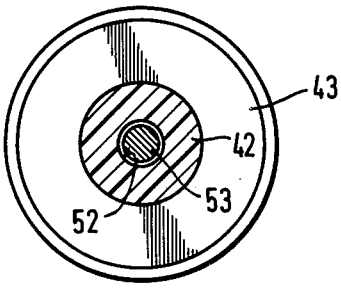
FIG. 7 is a cross section taken along line VII—VII in FIG. 4.
Figure 10:
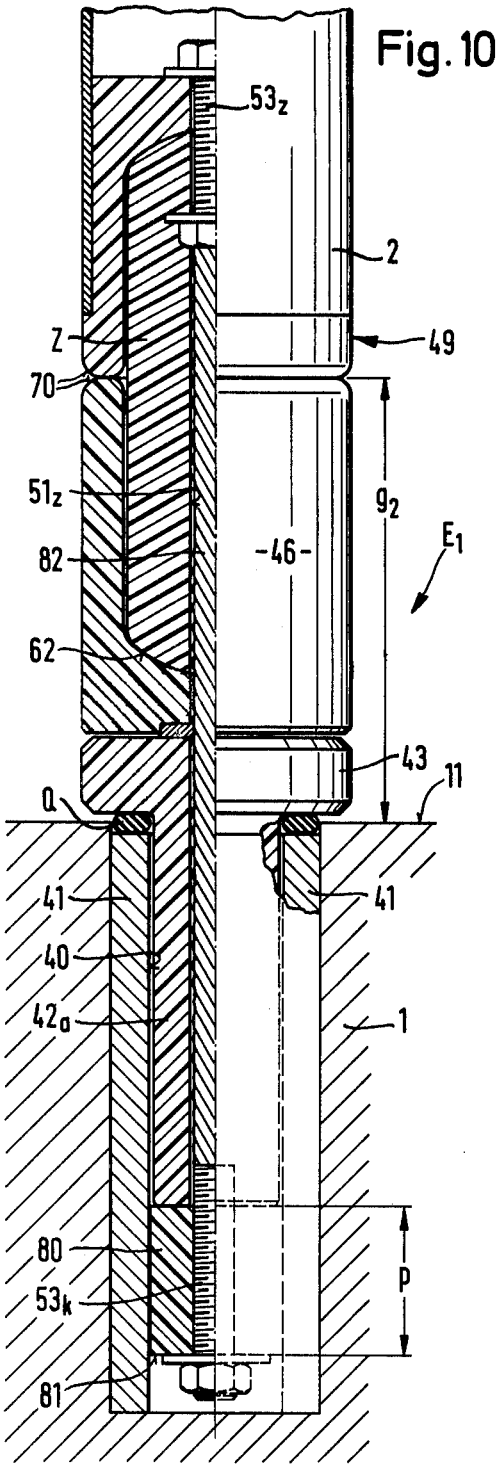
FIG. 10 shows another embodiment of the mast heel joint partially in section with the mast in erect position.

The tubular mast 2 of an outer diameter 1 of 40 mm and a wall thickness j of 1.5 mm is firmly connected to the second joint part 49, i.e., as shown in FIGS. 4, 8, by insertion in the mast of a reduced diameter insertion pin 50 formed on the upper end of joint part 49. The pin 50 of the joint part 49 is traversed by an axial bore 51 as is the lower joint part 52 whose bore 51 is aligned with a bore 52 in the plug-in pin 42. In these bores 51, 52 there are arranged screw bolts 53 and $53_z$ whose screw heads 54 rest —with interposed washers 55—on the end surfaces 57 and 58 respectively of the insertion pin 50 and pin 42; a threaded end 59 of each screw bolt 53 is seated in threaded inserts 60 of the cylindrical block Z. Said threaded inserts 60 are cast or vulcanized in the elastomer block Z whose end surfaces 61 are connected with the inner walls of the bushings 46, 48 either by an end disk 47 (FIG. 4) or, as shown in FIG. 10, by adhesive layers 62; parts of the cylindrical outer surface 63 of the block Z can also rest with adherence against said bushings.

The edges 70 of the two joint parts 45, 49 abut against each other in the normal vertical position of the mast 2 and, upon inclination of the mast (FIGS. 3, 11) are the geometrical locus for the point of inclination. The lower edge 73 of the mast is spaced from said point, depending on the particular embodiment, by a distance g of 10 mm or $g_1$ of 70 mm. In the first-mentioned case, the bushing 48 itself forms the pin 50 while in the case of another embodiment (FIGS. 8, 12) is developed in addition on the bushings 48.

When the mast 2 is swung down from its main axis K, the block or the pin Z deforms and is stressed merely in tension since the compressive forces are taken up and transmitted further by the bushings 46, 48 which rest on top of each other at least at such point of inclination.

Figure 3:
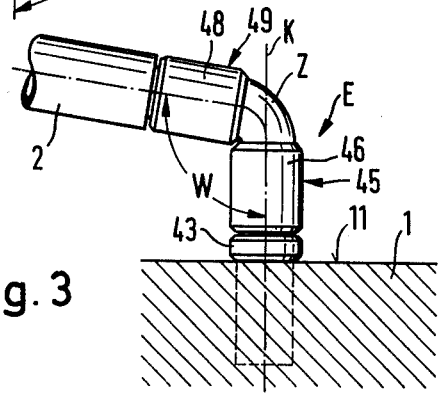
FIG. 3 shows the mast heel joint of FIG. 2 with the mast in an inclined position.

Due to the above-described construction of the joint E and the fact that the stress or force relations prevailing in the block Z are radially the same on all sides, the mast 2 can thus be swung down to a lower inclination angle w of about 90° with respect to the main axis K of the mast as indicated in FIG. 3 and then be returned almost automatically into its normal position.

Between the bearing collar 43 and the closed bushing end 75 there is seated—in part within the central cavity 76 thereof—a metal ring 77. The bearing collar 43 which is made of a thermosetting resin and the bushing 46 which is made of the same material are rotatable with respect to each other on the metal ring 77. In the embodiment shown in FIG. 4, a central pin of the joint part 45 which is close to the board and is surrounded by an annular recess 96 crossed by radial webs, not shown, is seated on the metal ring 77.

Figure 11:
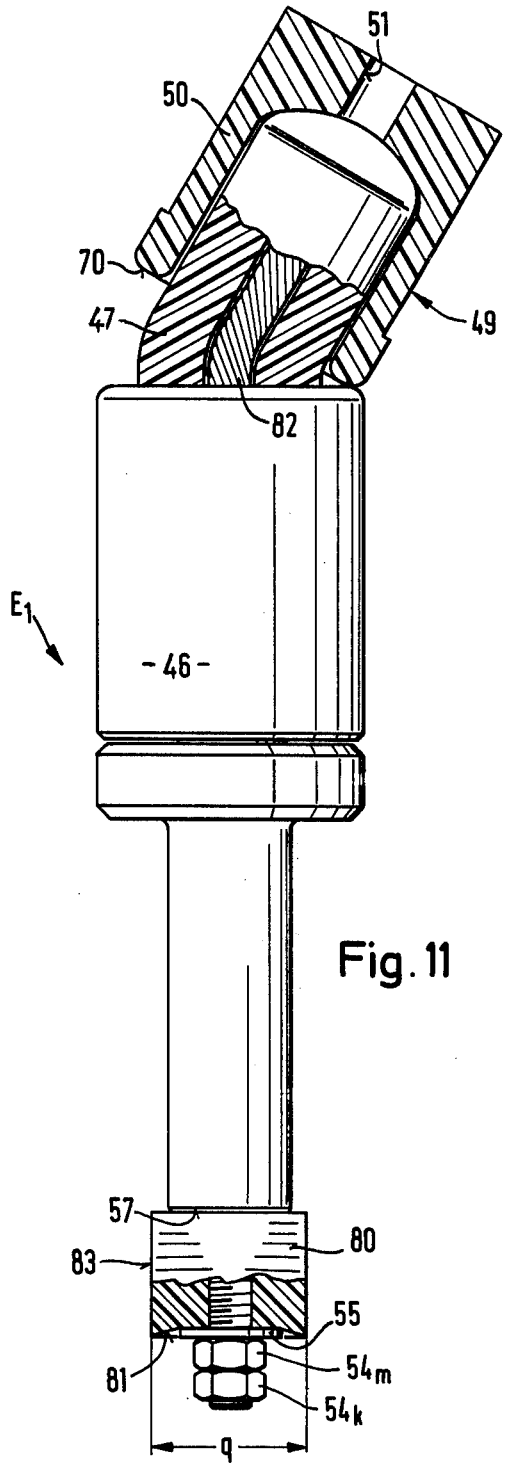
FIG. 11 shows the mast heel joint of FIG. 10 with the mast in inclined position.

In FIG. 10 the axial insertion pin $42_a$ of the joint $E_1$ is shortened by an amount p of, for instance, 2.5 cm as compared with the embodiments already described; adjoining the face surface 57 of the insertion pin $42_a$ is a pipe or block 80 of elastic material on the free face surface 81 of which there rests washer 55 for the screw head 54 which, in the embodiment shown in FIGS. 10, 11, is developed as a nut $54_m$ with lock nut $54_k$ and is screwed onto the threaded piece $53_k$ connected to wire rope 82.

The wire rope 82 passes through the axial boreholes 51, 52 and terminates in the elastomeric block Z where it is secured—lying in a channel $51_z$ of the block Z —to the upper screw bolt $53_z$ or to some other point of attachment.

If the mast 2 is tilted, the wire rope 82 pulls the lower screw head 54—and with it the front face 81 of the pipe or block 80—towards the mast. Since the block 80 rests against said face surface 81, the pressure exerted by the wire rope 82 leads to a shortening of the block length p and thus to a radial elongation of the block 80 whose diameter q is simultaneously increased.

The annular wall 83 of the block 80 which has been shortened in this manner places itself around the inner side of the bushing 41 and thus forms a coupling between mast 2 and sailboard 1 which coupling becomes increasingly frictionally locked upon an increasing inclination of the mast.

The height $g_2$ of the tilting region 70 of the joint E from the standing surface 11 of the sailboard or water board 1 should be so established, for reasons of safety, that ones' foot standing on the water board 1 cannot be injured by the tilted mast 2.

The joint $E_2$ of FIG. 12 has an upper joint part $49_k$ which widens towards the mast and an insertion pin $50_k$ which itself is formed as a cylindrical bushing and provided with the mast heel rope 7.

At the lower end of the screw bolt 53 there is an eye 86 to which a catch line 87 for the mast is attached. This line is connected at the other end to a tension spring or rubber band 80 in a catch-line box 89 with cover 90 which can be engaged at the bottom side 10 of the board. The catch-line box 89 terminates in the region of the mast heel sleeve 41 in a cylinder shoe 92 which is displaceable telescopically on said sleeve or on a shoulder-like part 91, as a result of which the structural unit consisting of the mast heel sleeve 41 and catch-line box 89 can be adapted to the height $b_1$ of the board.

In the embodiment shown in FIGS. 13 and 14, the catch-line box $89_h$ is connected on the top side 11 of the board as a compact insertion element with the mast heel sleeve 41 and receives a pulley 93 from which the catch line 87 unwinds against the opposing force of, for instance, a spring 94 when the mast heel joint E comes loose from the sailboard 1.

In accordance with FIG. 15, the catch line 87 extends through a keel groove 95 of the sailboard 1 and its elastic end 88 is attached to an eye 85 at the centerboard 9. The stretchability of the elastic end 88 is so determined that, on the one hand, the mast heel joint E can move only slightly away from the sailboard 1 and, on the other hand, the catch line 87, when the mast 2 is inserted, rests tightly in the keel groove 94.

In an embodiment which has not been shown in the drawing, the catch line 87 can also be guided through a tube inserted into the sailboard 1—instead of through the keel groove 94—and be fastened fore and aft. In the case of hollow sailboards 1, the catch line 87 may pass within the body of the board.

In all the cases described, the catch line 87 does not lie on the standing surface in the traveling position of the sailboard 1, and is therefore protected from being grasped or being struck by the foot of the user.

I claim:

1. A sailboard for wind surfing comprising a board, a mast, heel joint means detachably supporting said mast on said board for freely rotatable and pivotable movement with respect thereto, and a sail stretched on said mast, said heel joint means comprising two opposed bushings one coupled to said mast and the other to said board, said bushings having opposed edges abutting against one another, and a block of material of high elasticity engaged in said bushings and coupled thereto to permit elastic pivotal movement of said mast by rocking of the bushings on one another, said block of material being resistant to water and heat, said heel joint means further comprising a plug-in pin removably engageable in a recess provided in said board and means interposed between said other of the bushings and said pin to provide rotation of said other bushing with respect to said recess, said recess having a depth greater than the length of the plug-in pin, the heel joint means further comprising an end pin of limited deformability adjoining and coupled to said plug-in pin at the end thereof inserted in said recess.

2. A sailboard as claimed in claim 1 comprising a catch line connecting the assembly of the mast and heel joint means to said board.

3. A sailboard as claimed in claim 2 wherein said board has an upper surface on which the user of the sailboard can stand, said catch line being supported remotely from said upper surface of the board and being reducible in length.

4. A sailboard as claimed in claim 3 wherein said heel joint means further comprises a plug-in pin removably engageable in a recess provided in said board and means interposed between said other of the bushings and said pin to provide rotation of said other bushing with respect to said recess, said catch line being coupled to said pin for being introduced with the latter into said recess.

5. A sailboard as claimed in claim 4 wherein said board has a bottom surface with a guide groove therein, said catch line extending in said guide groove.

6. A sailboard as claimed in claim 5 comprising a holding member on said bottom surface of the board, said catch line having one end secured to said holding member.

7. A sailboard as claimed in claim 4 wherein said board has a cavity therein extending into said recess, said catch line being secured in said cavity.

8. A sailboard as claimed in claim 7 comprising a catch line box in said cavity, a pulley in said catch line box, said catch line having one end secured to said pulley, and elastic means acting on said pulley to oppose unwinding of the catch line from the pulley.

9. A sailboard as claimed in claim 7 comprising a catch line box in said cavity for storage of a length of catch line, said catch line box including a collar, and a sleeve in said board for receiving said plug-in pin, said sleeve and collar being telescopically engageable.

10. A sailboard as claimed in claim 9 wherein said board has a lower surface with a cavity which extends into said recess, said catch line box being insertable from below said board into said cavity, said sleeve being insertable in said recess from above said board for telescopically engaging said catch line box.

11. A sailboard as claimed in claim 1 wherein said block of material is cylindrical and has radial stress properties which are approximately equal with respect to the axis thereof.

12. A sailboard as claimed in claim 11 wherein said block of material is an elastomeric material.

13. A sailboard as claimed in claim 12 comprising adhesive means joining said block of material to said bushings.

14. A sailboard as claimed in claim 12 comprising threaded bolts secured in said block at opposite ends thereof, said bolts being engaged with respective bushings.

15. A sailboard as claimed in claim 14 comprising nuts secured in said block at said opposite ends, said bolts being threadably engaged with said nuts.

16. A sailboard as claimed in claim 14 wherein said one bushing includes an insertion portion of reduced diameter engaged in said mast, said threaded bolt which is engaged with said one bushing being an abutment with an end surface of said insertion portion.

17. A sailboard as claimed in claim 14 wherein the abutting edges of the bushings are seated on one another with the mast vertical, said bushings surrounding said block and being relatively displacable against the opposition of said block.

18. A sailboard as claimed in claim 17 wherein said abutting edges are rounded and constitute rocking surfaces on which the bushings can pivot with respect to one another and produce deformation of said block.

19. A sailboard as claimed in claim 17 comprising a bearing collar on said plug-in pin bearing on said board.

20. A sailboard as claimed in claim 19 wherein said heel joint means further comprises a pull member secured to said plug-in pin and displaceable axially upon a change in position of the mast.

21. A sailboard as claimed in claim 20 wherein said block has an axial bore in which said pull member freely passes, said heel joint means further comprising means connecting said pull member to said one bushing.

22. A sailboard as claimed in claim 21 wherein said pull member is a wire cable extending through an axial bore provided in said end pin, the heel joint means further comprising means engaging said pull member and bearing against said end pin.

23. A sailboard as claimed in claim 22 wherein said end pin is so positioned in said recess and dimensioned to bear at its periphery against the inner wall of said recess as said end pin is deformed when the mast is pivoted.

24. A sailboard as claimed in claim 19 wherein said threaded bolt which is engaged with said other bushing is in abutment with said plug-in pin.

25. A sailboard as claimed in claim 24 wherein said plug-in pin and bearing collar are rotatable with respect to said other bushing.

26. A sailboard as claimed in claim 25 comprising an annular member disposed between said bearing collar and said other bushing, said threaded bolt engaged with said other bushing passing through said annular member.

* * * * *